US010436512B1

(12) United States Patent
Wingens

(10) Patent No.: US 10,436,512 B1
(45) Date of Patent: Oct. 8, 2019

(54) BASE COMPONENT FOR A THERMOPROCESSING SYSTEM, A THERMOPROCESSING SYSTEM, AND A THERMOPROCESSING METHOD

(71) Applicant: Thomas Wingens, Sewickley, PA (US)

(72) Inventor: Thomas Wingens, Sewickley, PA (US)

( * ) Notice: Subject to any disclaimer, the term of this patent is extended or adjusted under 35 U.S.C. 154(b) by 0 days.

(21) Appl. No.: 15/662,312

(22) Filed: Jul. 28, 2017

Related U.S. Application Data

(60) Provisional application No. 62/367,965, filed on Jul. 28, 2016.

(51) Int. Cl.

| | |
|---|---|
| ***F27B 5/04*** | (2006.01) |
| ***F27B 5/16*** | (2006.01) |
| ***F27D 7/06*** | (2006.01) |
| ***F27D 3/00*** | (2006.01) |
| ***F27B 1/20*** | (2006.01) |
| ***F27D 3/12*** | (2006.01) |

(52) U.S. Cl.
CPC ..... *F27D 3/00* (2013.01); *F27B 1/20* (2013.01); *F27D 3/12* (2013.01); *F27D 2003/0001* (2013.01); *F27D 2007/063* (2013.01)

(58) Field of Classification Search
CPC . F27D 1/0043; F27D 7/04; F27D 7/06; C21D 9/0043; F27B 5/04; F27B 5/16; F27B 9/04; F27B 9/042
See application file for complete search history.

(56) References Cited

U.S. PATENT DOCUMENTS

| | | | | |
|---|---|---|---|---|
| 3,020,032 | A * | 2/1962 | Casey | C21D 1/773 266/108 |
| 4,612,064 | A * | 9/1986 | Schmetz | C21D 1/74 148/628 |
| 5,951,282 | A * | 9/1999 | Sakata | H01L 21/67109 432/11 |
| 6,142,773 | A * | 11/2000 | Shimazu | C23C 16/4401 118/733 |
| 6,250,907 | B1 * | 6/2001 | Bergman | B22F 3/15 219/400 |
| 6,328,560 | B1 * | 12/2001 | Fujikawa | C23C 14/046 432/205 |
| 7,584,697 | B2 * | 9/2009 | Yamauchi | B22F 3/03 100/269.01 |
| 8,652,370 | B2 * | 2/2014 | Fujikawa | B30B 11/002 264/314 |
| 9,358,747 | B2 * | 6/2016 | Gardin | B22F 3/003 |

* cited by examiner

*Primary Examiner* — Gregory A Wilson
(74) *Attorney, Agent, or Firm* — Michael P. Alexander

(57) ABSTRACT

A base component may be uses in a thermoprocessing system that includes the base component and at least one recipient enclosure for sealing a process chamber of the thermoprocessing system from an exterior thereof. The base component includes a main hub, and the main hub includes: an energy penetration for providing a heating or cooling energy from an exterior of the process chamber to the process chamber; a media inlet penetration for transporting a media from an exterior of the process chamber to the process chamber; and a media outlet penetration for transporting a media from the process chamber to an exterior of the process chamber.

10 Claims, 4 Drawing Sheets

BASE COMPONENT FOR A THERMOPROCESSING SYSTEM, A THERMOPROCESSING SYSTEM, AND A THERMOPROCESSING METHOD

PRIORITY

The present invention claims the priority of U.S. Provisional Patent Application No. 62/367,965, filed Jul. 28, 2016, which is incorporated herein by reference in its entirety.

FIELD

The present invention generally relates to thermoprocessing systems, components thereof, and methods for thermally treating a load, such as for thermally treating loads made by an additive manufacturing process.

BACKGROUND

Thermoprocessing systems have been used to alter the properties of a material. Those skilled in the art continue with research and development in field of thermoprocessing systems, components thereof, and methods for thermally treating a load, such as for thermally treating loads made by an additive manufacturing process.

SUMMARY

In an aspect, there is a base component for use in a thermoprocessing system that includes the base component and at least one recipient enclosure for sealing a process chamber of the thermoprocessing system from an exterior thereof. The base component includes a main hub, and the main hub includes: an energy penetration for providing a heating or cooling energy from an exterior of the process chamber to the process chamber; a media inlet penetration for transporting a media from an exterior of the process chamber to the process chamber; and a media outlet penetration for transporting a media from the process chamber to an exterior of the process chamber.

In an aspect, the surface of the main hub facing the process chamber is configured to receive the at least one recipient enclosure.

In an aspect, the main hub includes one or more connectors on a surface of the main hub facing the process chamber.

In an aspect, the base component further includes a base ring, and the base ring includes: one or more connectors on a surface of the base ring facing the main hub for reversibly connecting with the one or more connectors of the main hub.

In an aspect, the surface of the base ring facing the process chamber is configured to receive the at least one recipient enclosure.

In an aspect, there is a thermoprocessing system for treating a workpiece in a process chamber of the thermoprocessing system. The thermoprocessing system includes a base component and at least one recipient enclosure sealing the process chamber of the thermoprocessing system from an exterior thereof. The base component includes a main hub, the main hub including: an energy penetration for providing a heating or cooling energy from an exterior of the process chamber to the process chamber; a media inlet penetration for transporting a media from an exterior of the process chamber to the process chamber; and a media outlet penetration for transporting a media from the process chamber to an exterior of the process chamber. The at least one recipient enclosure extends from an open end sealed to a surface of the base component facing the process chamber to a closed distal end of the recipient enclosure and extending circumferentially around a periphery of the process chamber.

In an aspect, the thermoprocessing system includes one or more connectors on a surface of the main hub facing the process chamber.

In an aspect, the base further includes a base ring, the base ring including: one or more connectors on a surface of the base ring facing the main hub for reversibly connecting with the one or more connectors of the main hub, wherein the at least one recipient enclosure is sealed to a surface of the base ring facing the process chamber.

In an aspect, there is a thermoprocessing method, including: providing a load to the process chamber of the described thermoprocessing system; adjusting a pressure inside the cavity to a desired pressure between 0 to 10,000 bar (0 to 1,000 MPa); and adjusting a temperature inside the cavity to a desired temperature between 0 to 3000 degrees K.

DETAILED DESCRIPTION

Figure 1:
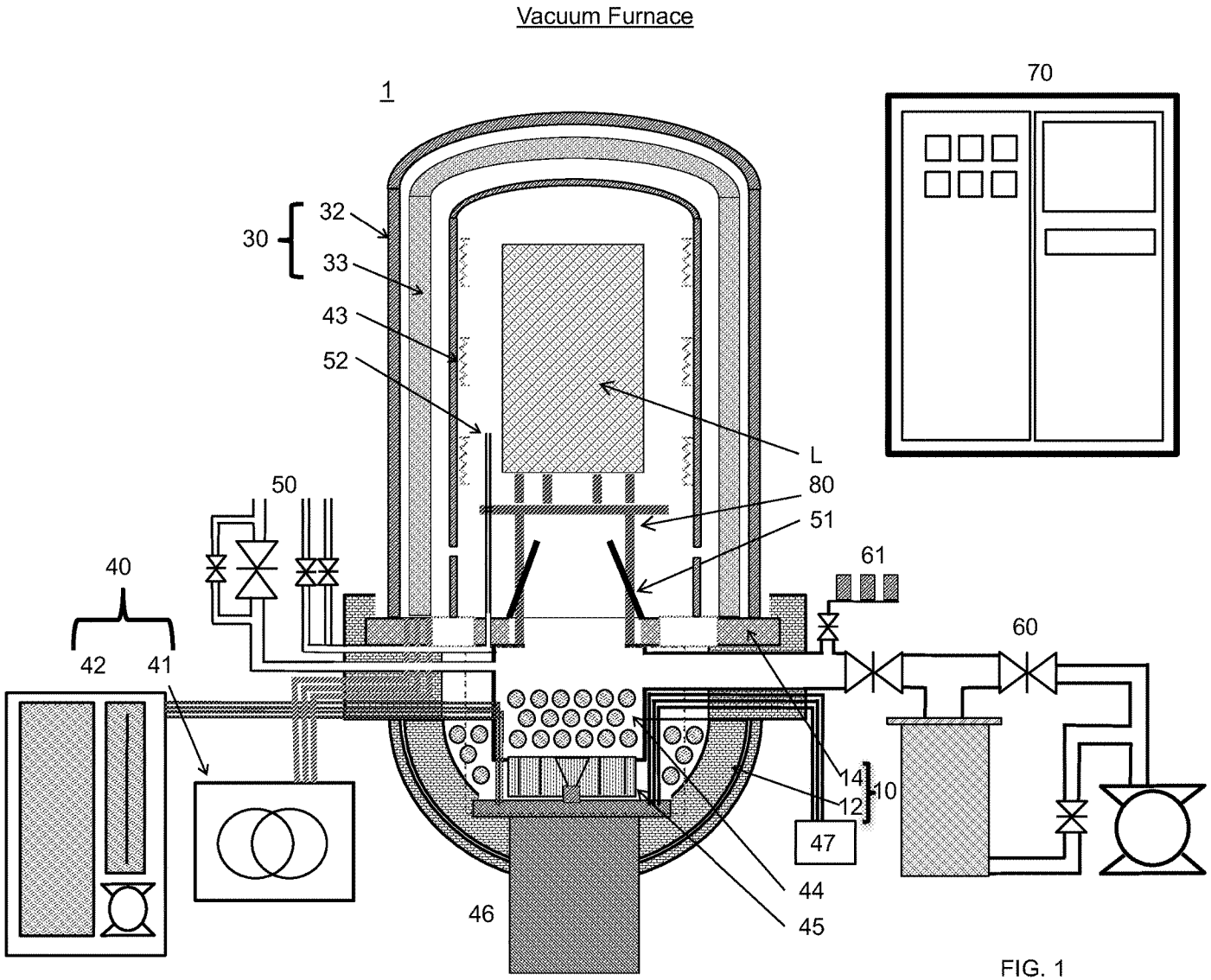
FIG. 1 illustrates a schematic drawing of a first example of a thermoprocessing system according to an embodiment of the present invention.

Reference will now be made in detail to the present embodiments of the invention, examples of which are illustrated in the accompanying drawings. Wherever possible, the same reference numbers will be used throughout the drawings to refer to the same or like parts.

A base component is provided for a thermoprocessing system that includes the base component and at least one recipient enclosure for sealing a process chamber of the thermoprocessing system from an exterior thereof. The base component includes at least a main hub, which includes at least an energy penetration for providing a heating or cooling energy from an exterior of the process chamber to the process chamber, a media inlet penetration for transporting a media from an exterior of the process chamber to the process chamber, and a media outlet penetration for transporting a media from the process chamber to an exterior of the process chamber.

The base component may consist of only the main hub, or the base component may include one or more other parts. In a preferred aspect, the base component includes the main hub and a base ring, such as described in more detail below.

By including the above-identified penetrations in the main hub, it becomes possible to advantageously avoid penetrations in the at least one recipient enclosure for these same functions, thereby removing design requirements for accommodating the corresponding penetrations in the at least one recipient enclosure. Additionally, avoiding the above-identified penetrations in the at least one recipient enclosure enables a modular thermoprocessing system, in which customized attachment of various recipient enclosures for achieving desired functions is provided. In a preferred aspect, all perforations into the process chamber from an exterior of the process chamber are provided through the main hub, so that no penetrations are present in the at least one recipient enclosure.

The shape, size, and arrangement of penetrations are not limited, except that the penetrations penetrate to the process chamber from an exterior of the process chamber. In the drawings, it would be understood that the thermoprocessing system is illustrated in two dimensions and that the size, shape, and arrangement of the penetrations are not precisely indicated in the two-dimensional representation. It would also be understood that the penetrations could be shaped, sized, and arranged in various manners within the three dimensions of the main hub.

The main hub is not limited by the arrangement of the thermoprocessing system. In an exemplary embodiment, the main hub may be configured for use in a vertically loaded thermoprocessing system such as illustrated in FIGS. 1 to 4. In another exemplary embodiment, the main hub may be configured for use in a horizontally loaded thermoprocessing system (not illustrated).

The main hub is not limited by shape, except that main hub must accommodate, either alone or in combination with one or more other parts of the base component, the sealing of the process chamber of the thermoprocessing system from an exterior thereof by the at least one recipient enclosure.

The main hub is not limited by material. In an exemplary embodiment, the material of the main hub may include a metallic material, a non-metallic material, or combinations thereof. The metallic material may include a pure metal, an alloy, or an intermetallic compound. In a preferred embodiment, the metallic material may be nickel-based. In another preferred embodiment, the metallic material may be iron-based. In another exemplary embodiment, the non-metallic material of the main hub may include an inorganic material. In another exemplary embodiment, the material of the main hub may include a fiber compound, such as a carbon fiber compound.

The main hub is not limited by method of manufacture.

In an exemplary aspect, the surface of the main hub facing the process chamber may be configured to receive at least one recipient enclosure to seal the process chamber of the thermoprocessing system from an exterior thereof. The means for receiving the at least one recipient enclosure are not limited. For example, the recipient enclosure may be sealed to the surface of the main hub by a reversible method, such as by clamping, or the recipient enclosure may be sealed to the surface of the main hub by an irreversible method, such as by welding.

In another exemplary aspect, the base component may further include a base ring, and the main hub and the base ring may be reversibly connected together. In this case, the surface of the base ring facing the process chamber may be configured to receive the at least one recipient enclosure. The means for receiving the at least one recipient enclosure are not limited. For example, the recipient enclosure may be sealed to the surface of the base ring by a reversible method, such as by clamping, or the recipient enclosure may be sealed to the surface of the base ring by a irreversible method, such as by welding.

The means for reversibly connecting the base ring and the main hub are not limited. In a preferred embodiment, the surface of the main hub facing the process chamber includes one more connectors, and the surface of the base ring facing the main hub includes one or more connectors for reversibly connecting with the one or more connectors of the main hub.

When the base component includes the base ring, an advantageous feature is effected that a load to be thermally processed may be inserted through the base ring without unsealing the connection between the base ring and the at least one recipient enclosure. Thus, the multiple loads may be thermally processed in sequence by disconnecting the base ring and main hub, replacing the treated load with the next load to be treated, and then again connecting the base ring and main hub.

The base ring is not limited by shape, except that the shape of the base ring must accommodate the reversible connection with the main hub and the receipt of at least one recipient enclosure.

The base ring is not limited by material. In an exemplary embodiment, the material of the base ring may include a metallic material, a non-metallic material, or combinations thereof. The metallic material may include a pure metal, an alloy, or an intermetallic compound. In another exemplary embodiment, the non-metallic material of the main hub may include an inorganic material.

The base ring is not limited by method of manufacture.

In another embodiment of the present invention, provided is a thermoprocessing system for treating a workpiece in a process chamber of the thermoprocessing system. The thermoprocessing system includes a base component as described above and at least one recipient enclosure sealing the process chamber of the thermoprocessing system from an exterior thereof.

The at least one recipient enclosure may extend from an open end sealed to a surface of the base component facing the process chamber to a closed distal end of the recipient enclosure and may extend circumferentially around a periphery of the process chamber.

The recipient enclosure may include a variety of types of recipient enclosures depending the desired function. For example, a recipient enclosure may include a high pressure vessel, a thermally conductive pressure vessel, or a thermal enclosure as described in the following examples.

The recipient enclosures may include walls that extend from an open end sealed to a surface of the base component facing the process chamber to a closed distal end of the recipient enclosure and may extend circumferentially around a periphery of the process chamber.

The thermoprocessing system may include one or more other parts for performing various functions, such as one or more energy sources (electrical energy source and/or thermal energy source), one or more heating elements, a heat exchanger, a blower fan, a blower motor, a variable frequency drive, a media source, a baffle system, a gasbaffle, a media drain (such as vacuum pump), pressure and vacuum gauges, a programmable logic controller, and a hearth/hearth support.

In another embodiment of the present invention, provided is a thermoprocessing method for treating a workpiece in a process chamber of the thermoprocessing system. The thermoprocessing method includes providing a load to the process chamber of the abovedescribed thermoprocessing system, adjusting a pressure inside the cavity to a desired pressure between 0 to 10,000 bar (0 to 1,000 MPa), and adjusting a temperature inside the cavity to a desired temperature between 0 to 3000 degrees K. Due to the ability to provide for a modular thermoprocessing system, in which customized attachment of various recipient enclosures for achieving desired functions may be provided, the thermoprocessing system may be employed for a broad range of thermoprocessing methods. For example, the thermoprocessing methods may include vacuum heat treating (such as examples 1 and 4 below), nitriding/tempering (such as example 2 below), or hot isostatic pressing or sinter hot isostatic pressing (such as example 3 below).

The following examples are provided to support the practice of the present invention and are not meant and should not be construed to limit the scope of the claims appended hereto.

Example 1—Vacuum Furnace

FIG. 1 illustrates an example of the present invention in which a base component 10 is used in a thermoprocessing system 1 for use as a vacuum furnace. The base component 10 includes a main hub 12, which includes energy penetrations for providing a heating or cooling energy from energy sources 40 to the process chamber. More specifically, the main hub 12 includes a first energy penetration for providing a heating energy from electrical energy source 41 to the process chamber and a second energy penetration for providing a cooling energy from thermal energy source 42 to the process chamber. The base component 10 further includes a media inlet penetration for transporting a media from media source 50 to the process chamber. When used as a vacuum furnace, the media may be, for example, an inert gas for filling the process chamber after the vacuum process is completed. The base component 10 further includes a media outlet penetration for transporting a media from the process chamber to the media drain 60. When used as a vacuum furnace, the media drain 60 may be a vacuum system, and the thermoprocessing system 1 may include pressure and vacuum gauges 61. In the example, the thermoprocessing system 1 may further include a base ring 14, at least one recipient enclosure 30, heating elements 43, heating exchanger 44, blower fan 45, blower motor 46, variable frequency drive 47, baffle system 51, gasbaffle 52, programmable logic controller 70, and hearth/hearth support 80.

In a method of thermoprocessing using the thermoprocessing system 1, a load L may be supported by hearth/hearth support 80 above the main hub 12. Then the base ring 14 with at least one recipient enclosure 30 sealed thereto may be brought over the load L and the base ring 14 may be reversibly connected to the main hub 12 to seal the process chamber from an exterior of the process chamber. In the illustrated example, the at least one recipient enclosure 30 includes a thermally conductive pressure vessel 32 and a thermal enclosure 33. After sealing, heating elements 43 may be heated by the heating energy penetrating through the base hub 12 from the electrical energy source 41 to heat the interior of the process chamber to a desired temperature, and the process chamber may be evacuated using vacuum system 60 by passing gas from the process chamber through a penetration in the base hub 12 to an exterior of the process chamber. After the vacuum heating treatment is complete, an inert gas may be passed from the media source 50 through a penetration in the base hub 12 to the process chamber, and a cooling energy may be passed from thermal energy source 42 through a penetration in the base hub 12 to the heat exchanger 44 in the process chamber. The blower fan 45, blower motor 46, and variable frequency drive 47 may be used to further control the cooling speed of the load L, and the baffle system 51 and gasbaffle 52 may be used to direct the flow of gas into and throughout the process chamber. The programmable logic controller 70 may be used to control the multiple processes of the thermoprocessing method.

After the thermoprocessing of the load L is complete, the base ring 14 may be disconnected from the main hub 12, and load L may be removed from the process chamber. Another load L may be provided to the process chamber, and the base ring 14 may be reversibly connected to the main hub 12 to begin thermoprocessing of the load L.

Example 2—Retort Nitrider/Temper Furnace

Figure 2:
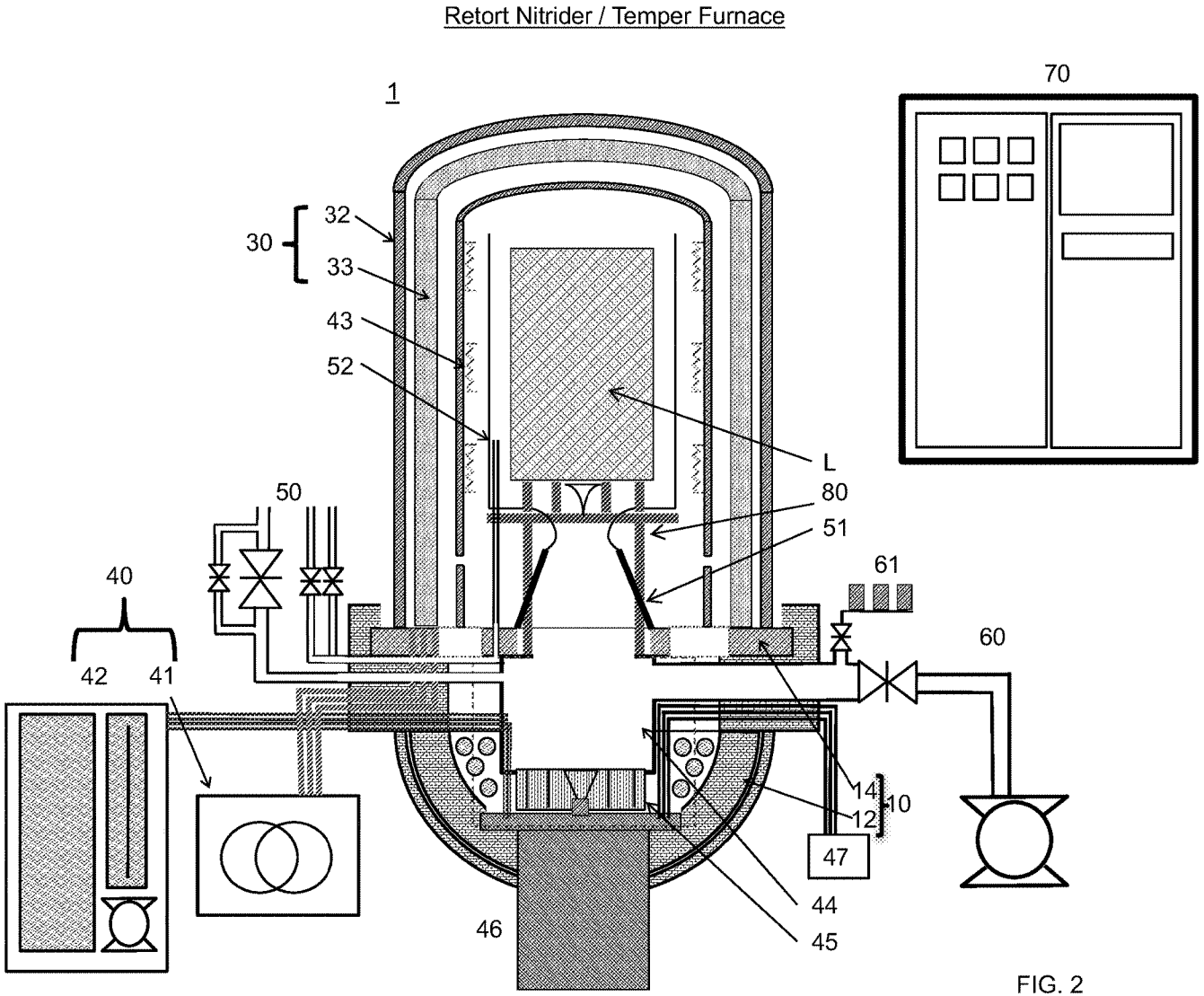
FIG. 2 illustrates a schematic drawing of a second example of a thermoprocessing system according to an embodiment of the present invention.

FIG. 2 illustrates an example of the present invention in which a base component 10 is used in a thermoprocessing system 1 for use as a retort intruder or temper furnace. The base component 10 includes a main hub 12, which includes energy penetrations for providing a heating or cooling energy from energy sources 40 to the process chamber. More specifically, the main hub 12 includes a first energy penetration for providing a heating energy from electrical energy source 41 to the process chamber and a second energy penetration for providing a cooling energy from thermal energy source 42 to the process chamber. The base component 10 further includes a media inlet penetration for transporting a media from media source 50 to the process chamber. When used as a retort nitrider, the media may be, for example, a nitriding gas for filling the process chamber during nitriding treatment. When used as a temper furnace, the media may be any desired media required for the tempering treatment.

The base component 10 further includes a media outlet penetration for transporting a media from the process chamber to the media drain 60. In the example, the thermoprocessing system 1 may further include a base ring 14, at least one recipient enclosure 30, heating elements 43, heating exchanger 44, blower fan 45, blower motor 46, variable frequency drive 47, baffle system 51, gasbaffle 52, programmable logic controller 70, and hearth/hearth support 80.

In a method of thermoprocessing using the thermoprocessing system 1, a load L may be supported by hearth/hearth support 80 above the main hub 12. Then the base ring 14 with at least one recipient enclosure 30 sealed thereto may be brought over the load L and the base ring 14 may be reversibly connected to the main hub 12 to seal the process chamber from an exterior of the process chamber. In the illustrated example, the at least one recipient enclosure 30 includes a thermally conductive pressure vessel 32 and a thermal enclosure 33. After sealing, heating elements 43 may be heated by the heating energy penetrating through the base hub 12 from the electrical energy source 41 to heat the interior of the process chamber to a desired temperature, and the process chamber may be filled with a desired media by passing gas from the media source 50 to the process chamber through a penetration in the base hub 12. After the nitriding or tempering treatment is complete, the media may be removed from the process chamber to the media drain 60 through a penetration in the base hub 12, and a cooling energy may be passed from thermal energy source 42 through a penetration in the base hub 12 to the heat exchanger 44 in the process chamber. The blower fan 45, blower motor 46, and variable frequency drive 47 may be used to further control the cooling speed of the load L, and the baffle system 51 and gasbaffle 52 may be used to direct the flow of gas into and throughout the process chamber. The programmable logic controller 70 may be used to control the multiple processes of the thermoprocessing method.

After the thermoprocessing of the load L is complete, the base ring 14 may be disconnected from the main hub 12, and load L may be removed from the process chamber. Another load L may be provided to the process chamber, and the base ring 14 may be reversibly connected to the main hub 12 to begin thermoprocessing of the load L.

Example 3—Hot Isostatic Pressing/Sinter-Hot Isostatic Pressing

Figure 3:
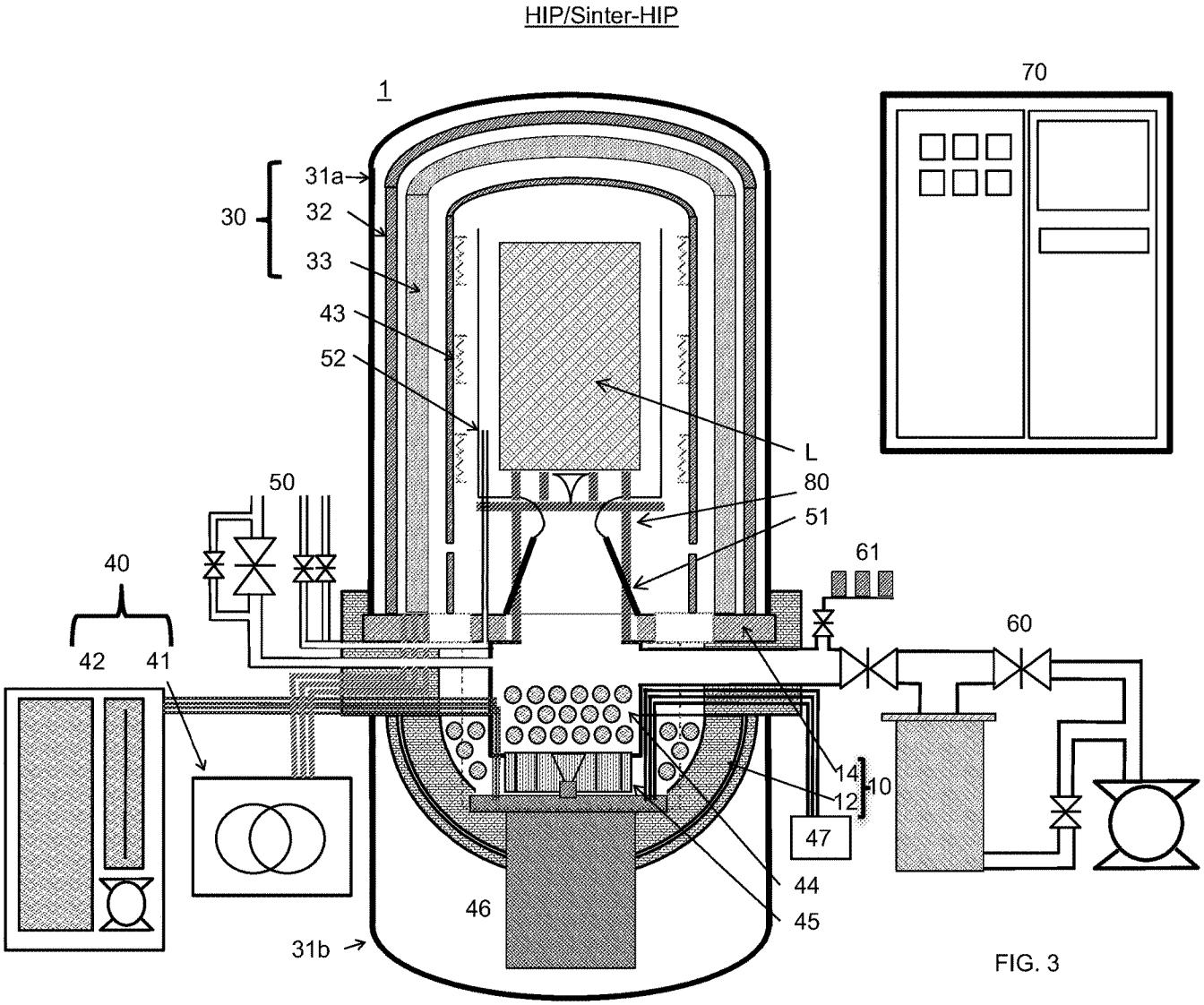
FIG. 3 illustrates a schematic drawing of a third example of a thermoprocessing system according to an embodiment of the present invention.

FIG. 3 illustrates an example of the present invention in which a base component 10 is used in a thermoprocessing system 1 for use in hot isostatic pressing or sinter-hot isostatic pressing. The base component 10 includes a main hub 12, which includes energy penetrations for providing a heating or cooling energy from energy sources 40 to the process chamber. More specifically, the main hub 12 includes a first energy penetration for providing a heating energy from electrical energy source 41 to the process chamber and a second energy penetration for providing a cooling energy from thermal energy source 42 to the process chamber. The base component 10 further includes a media inlet penetration for transporting a media from media source 50 to the process chamber. When used in hot isostatic pressing the media source may be a high pressure system for providing a high pressure gas to the process chamber.

The base component 10 further includes a media outlet penetration for transporting a media from the process chamber to the media drain 60. In the example, the thermoprocessing system 1 may further include a base ring 14, at least one recipient enclosure 30, heating elements 43, heating exchanger 44, blower fan 45, blower motor 46, variable frequency drive 47, baffle system 51, gasbaffle 52, programmable logic controller 70, and hearth/hearth support 80.

In a method of thermoprocessing using the thermoprocessing system 1, a load L may be supported by hearth/hearth support 80 above the main hub 12. Then the base ring 14 with at least one recipient enclosure 30 sealed thereto may be brought over the load L and the base ring 14 may be reversibly connected to the main hub 12 to seal the process chamber from an exterior of the process chamber. In the illustrated example, the at least one recipient enclosure 30 includes high pressure vessel 31*a*, thermally conductive pressure vessel 32, and thermal enclosure 33. After sealing, heating elements 43 may be heated by the heating energy penetrating through the base hub 12 from the electrical energy source 41 to heat the interior of the process chamber to a desired temperature, and the process chamber may be pressurized with a desired media by passing gas from the media source 50 to the process chamber through a penetration in the base hub 12. After the hot isostatic pressing is complete, the media may be removed from the process chamber to the media drain 60 through a penetration in the base hub 12, and a cooling energy may be passed from thermal energy source 42 through a penetration in the base hub 12 to the heat exchanger 44 in the process chamber. The blower fan 45, blower motor 46, and variable frequency drive 47 may be used to further control the cooling speed of the load L, and the baffle system 51 and gasbaffle 52 may be used to direct the flow of gas into and throughout the process chamber. The programmable logic controller 70 may be used to control the multiple processes of the thermoprocessing method.

After the thermoprocessing of the load L is complete, the base ring 14 may be disconnected from the main hub 12, and load L may be removed from the process chamber. Another load L may be provided to the process chamber, and the base ring 14 may be reversibly connected to the main hub 12 to begin thermoprocessing of the load L.

Example 4—Top Loading (e.g. Pit Style) Furnace

Figure 4:
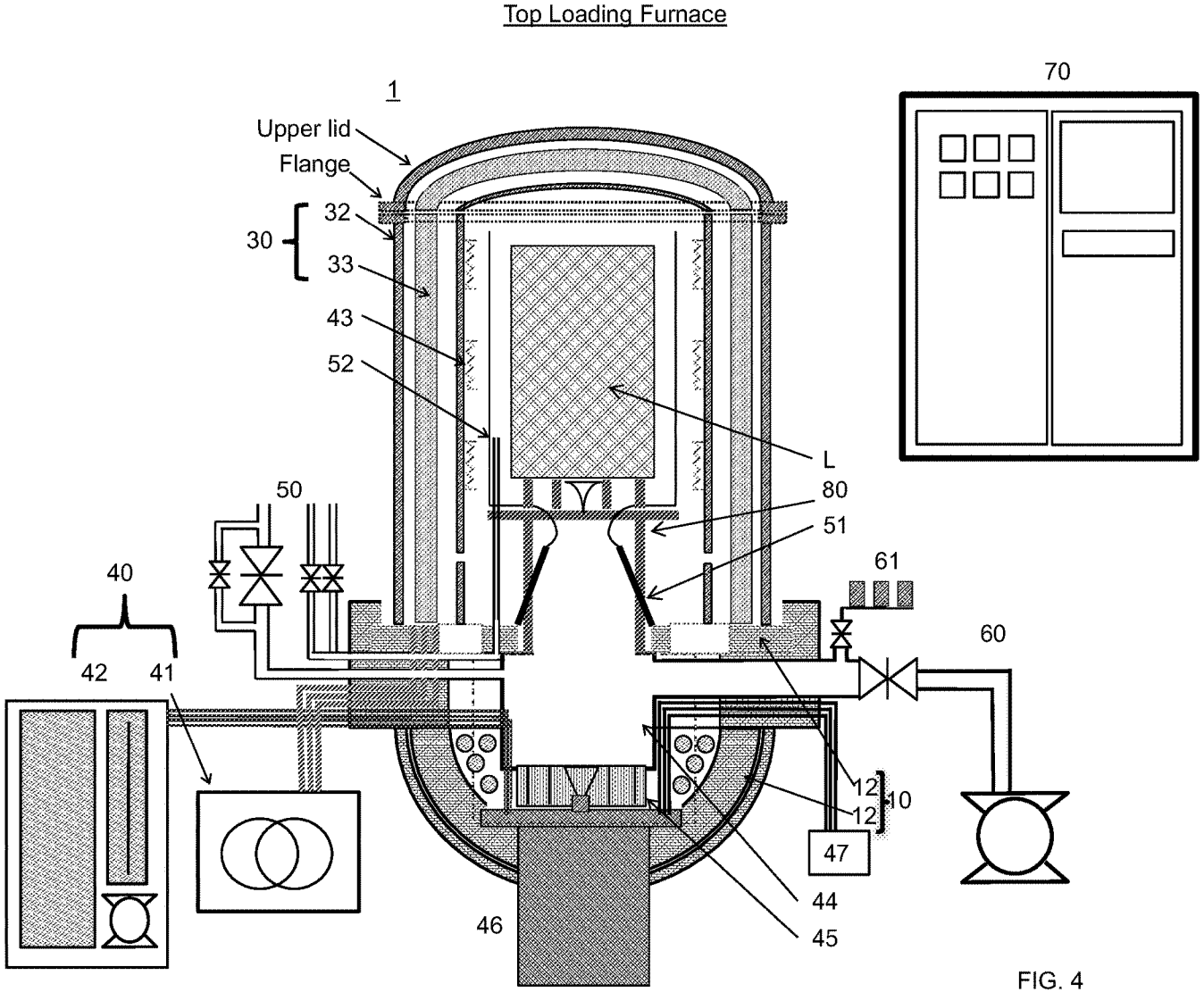
FIG. 4 illustrates a schematic drawing of a fourth example of a thermoprocessing system according to an embodiment of the present invention.

FIG. 4 illustrates a example of a thermoprocessing system, in which the furnace is a top loading furnace. The base component 10 includes a main hub 12, which includes energy penetrations for providing a heating or cooling energy from energy sources 40 to the process chamber. More specifically, the main hub 12 includes a first energy penetration for providing a heating energy from electrical energy source 41 to the process chamber and a second energy penetration for providing a cooling energy from thermal energy source 42 to the process chamber. The base component 10 further includes a media inlet penetration for transporting a media from media source 50 to the process chamber. The base component 10 further includes a media outlet penetration for transporting a media from the process chamber to the media drain 60. In the example, the thermoprocessing system 1 may further include at least one recipient enclosure 30, heating elements 43, heating exchanger 44, blower fan 45, blower motor 46, variable frequency drive 47, baffle system 51, gasbaffle 52, programmable logic controller 70, and hearth/hearth support 80.

In a method of thermoprocessing using the thermoprocessing system 1, the at least one recipient enclosure 30 may be sealed to the main hub 12 by any method, such as welding. A load L may be supported by hearth/hearth support 80 above the main hub 12. Then an upper lid 34 may be brought over the load L and the upper lid 34 may be reversibly connected to the at least one recipient enclosure 30 to seal the process chamber from an exterior of the process chamber using flange 35. In the illustrated example, the at least one recipient enclosure 30 includes thermally conductive pressure vessel 32, and thermal enclosure 33. After sealing, heating elements 43 may be heated by the heating energy penetrating through the base hub 12 from the electrical energy source 41 to heat the interior of the process chamber to a desired temperature, and the process chamber may be evacuated, pressured, or filling with a desired media by passing media from the media source 50 to the process chamber through a penetration in the base hub 12. After the treatment is complete, the media may be removed from the process chamber to the media drain 60 through a penetration in the base hub 12, and a cooling energy may be passed from thermal energy source 42 through a penetration in the base hub 12 to the heat exchanger 44 in the process chamber. The blower fan 45, blower motor 46, and variable frequency drive 47 may be used to further control the cooling speed of the load L, and the baffle system 51 and gasbaffle 52 may be used to direct the flow of gas into and throughout the process chamber. The programmable logic controller 70 may be used to control the multiple processes of the thermoprocessing method.

After the thermoprocessing of the load L is complete, the upper lid 34 may be disconnected from the at least one recipient enclosure 30, and load L may be removed from the process chamber. Another load L may be provided to the process chamber, and the upper lid 34 may be reversibly connected to the at least one recipient enclosure 30 to begin thermoprocessing of the load L.

REFERENCE NUMBERS

1 Thermoprocessing System
10 Base Component
12 Main Hub
14 Base Ring
30 Recipient Enclosure
31 High Pressure Vessel
32 Thermally Conductive Pressure Vessel
33 Thermal Enclosure
34 Upper Lid

35 Flanges
40 Energy Source
41 Electrical Energy Source
42 Thermal Energy Source
43 Heating Elements
44 Heat Exchanger
45 Blower Fan
46 Blower Motor
47 Variable Frequency Drive
50 Media Source
51 Baffle System
52 Gasbaffle
60 Media Drain
61 Pressure and Vacuum Gauges
70 Programmable Logic Controller
80 Hearth/Hearth Support
L Load Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

The invention claimed is:

1. A base component for use in a thermoprocessing system that comprises the base component and at least one recipient enclosure for sealing a process chamber of the thermoprocessing system from an exterior thereof, wherein the base component comprises a main hub, the main hub comprising:

an energy penetration for providing a heating or cooling energy from an exterior of the process chamber to the process chamber;

a media inlet penetration for transporting a media from an exterior of the process chamber to the process chamber; and a media outlet penetration for transporting a media from the process chamber to an exterior of the process chamber; and a base ring reversibly connecting to the main hub and configured to receive the at least one recipient enclosure.

2. The base component of claim 1, wherein the main hub includes one or more connectors on a surface of the main hub facing the process chamber.

3. The base component of claim 2, wherein the base ring comprises:

one or more connectors on a surface of the base ring facing the main hub for reversibly connecting with the one or more connectors of the main hub.

4. The base of claim 1, wherein a surface of the base ring facing the process chamber is configured to receive the at least one recipient enclosure.

5. A thermoprocessing system for treating a workpiece in a process chamber of the thermoprocessing system, comprising:

a base component, the base component comprising a main hub, the main hub comprising:

an energy penetration for providing a heating or cooling energy from an exterior of the process chamber to the process chamber;

a media inlet penetration for transporting a media from an exterior of the process chamber to the process chamber; and a media outlet penetration for transporting a media from the process chamber to an exterior of the process chamber; and at least one recipient enclosure sealing the process chamber of the thermoprocessing system from an exterior thereof, the at least one recipient enclosure extending from an open end sealed to a surface of the base component facing the process chamber to a closed distal end of the recipient enclosure and extending circumferentially around a periphery of the process chamber, the at least one recipient enclosure reversibly connecting to the main hub.

6. The thermoprocessing system of claim 5, wherein the thermoprocessing system includes one or more connectors on a surface of the main hub facing the process chamber.

7. The thermoprocessing system of claim 6, wherein the base further comprises a base ring, the base ring comprising:

one or more connectors on a surface of the base ring facing the main hub for reversibly connecting with the one or more connectors of the main hub, wherein the at least one recipient enclosure is sealed to a surface of the base ring facing the process chamber.

8. A thermoprocessing method, comprising:

providing a load to the process chamber of the thermoprocessing system of claim 5;

connecting the at least one recipient enclosure to the main hub, thereby sealing the load within the process chamber;

adjusting a pressure inside the process chamber to a desired pressure between 0 to 10,000 bar (0 to 1,000 MPa);

adjusting a temperature inside the process chamber to a desired temperature between 0 to 3000 degrees K;

disconnecting the at least one recipient enclosure from the main hub, thereby unsealing the load within the process chamber; and removing the load from the process chamber.

9. The thermoprocessing method of claim 8, wherein the thermoprocessing system includes one or more connectors on a surface of the main hub facing the process chamber.

10. The thermoprocessing method of claim 9, wherein the base component further comprises a base ring, the base ring comprising:

one or more connectors on a surface of the base ring facing the main hub for reversibly connecting with the one or more connectors of the main hub, wherein the at least one recipient enclosure is sealed to a surface of the base ring facing the process chamber.

* * * * *